US009131309B2

(12) United States Patent
Hankey et al.

(10) Patent No.: US 9,131,309 B2
(45) Date of Patent: Sep. 8, 2015

(54) WIRED HEADSET WITH INTEGRATED SWITCH

(71) Applicant: Apple Inc., Cupertino, CA (US)

(72) Inventors: M. Evans Hankey, San Francisco, CA (US); Eric B. Daniels, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/463,483

(22) Filed: Aug. 19, 2014

(65) Prior Publication Data

US 2014/0355782 A1 Dec. 4, 2014

Related U.S. Application Data

(63) Continuation of application No. 13/429,876, filed on Mar. 26, 2012, now Pat. No. 8,842,871, which is a continuation of application No. 11/824,031, filed on Jun. 28, 2007, now Pat. No. 8,144,915.

(60) Provisional application No. 60/879,155, filed on Jan. 6, 2007.

(51) Int. Cl.

| | |
|---|---|
| ***H04R 1/10*** | (2006.01) |
| ***H01H 9/02*** | (2006.01) |
| *H01H 3/00* | (2006.01) |
| *H04R 5/033* | (2006.01) |

(52) U.S. Cl.

CPC ..... *H04R 1/1041* (2013.01); *H01H 9/0228* (2013.01); *H01H 2003/007* (2013.01); *H04R 1/1016* (2013.01); *H04R 5/033* (2013.01)

(58) Field of Classification Search

CPC ..... H01H 9/02; H01H 9/0207; H01H 9/0214; H01H 9/0228; H01H 9/0235; H01H 2003/007; H01H 2221/09; H01H 2011/0081; H01H 13/00; H01H 13/10; H01H 2239/048; H04R 1/1041; H04R 5/033; H04R 1/10; H04R 1/1016; H04M 1/05; H04M 1/72527; H04M 1/6058

USPC ..... 381/74, 91, 107, 109, 370, 374, 375, 381/376, 355, 364, 367; 455/575.2; 200/405, 505, 1 B

See application file for complete search history.

(56) References Cited

U.S. PATENT DOCUMENTS

| | | | | |
|---|---|---|---|---|
| 6,078,825 | A * | 6/2000 | Hahn et al. | 455/569.2 |
| 6,122,369 | A * | 9/2000 | Hwang et al. | 379/420.04 |
| 6,397,087 | B1 * | 5/2002 | Kim et al. | 455/569.1 |
| 6,690,352 | B2 * | 2/2004 | Cheng et al. | 345/156 |
| 6,741,718 | B1 * | 5/2004 | Brumitt et al. | 381/370 |
| 6,771,780 | B2 * | 8/2004 | Hong et al. | 381/74 |
| 7,254,415 | B2 * | 8/2007 | Okamura | 455/556.1 |
| 7,319,762 | B2 * | 1/2008 | Andrea et al. | 381/74 |
| 8,213,660 | B2 * | 7/2012 | Phillips | 381/355 |
| 2006/0285715 | A1 * | 12/2006 | Drambarean et al. | 381/380 |

* cited by examiner

*Primary Examiner* — Vivian Chin
*Assistant Examiner* — Jason R Kurr
(74) *Attorney, Agent, or Firm* — Downey Brand LLP

(57) ABSTRACT

Headsets are provided with integrated switch assemblies. An integrated switch assembly can include a switch hidden from view by a housing. The switch can be activated when a user applies pressure to the housing. The housing may include a flexible housing cover that, when depressed, may engage the switch contained within the housing. When engaged, the switch may move or snap to a switch activation position within the housing.

20 Claims, 12 Drawing Sheets

WIRED HEADSET WITH INTEGRATED SWITCH

CROSS-REFERENCE TO RELATED APPLICATIONS

This is a continuation of U.S. Non-Provisional patent application Ser. No. 13/429,876 filed Mar. 26, 2012, which is a continuation of U.S. Non-Provisional patent application Ser. No. 11/824,031 filed Jun. 28, 2007, now U.S. Pat. No. 8,144,915 issued Mar. 27, 2012, which claims the benefit of U.S. Provisional Application No. 60/879,155, filed Jan. 6, 2007, each of which is hereby incorporated by reference herein in its entirety.

BACKGROUND OF THE INVENTION

The present invention can relate to headsets and, more particularly, to wired headsets including an integrated switch.

Electrical switches for controlling functions of electronic devices are well known. For example, some known media and communication devices include switches that are used to activate particular functions of the device (e.g., on/off, play, pause, select, or volume). To provide control of functions at a location remote from the media or communication device, switches that are electrically connected to and incorporated in wires attached to the device have been developed (e.g., switches in wired headsets plugged into a jack of an audio device). For example, a headset can include a wheeled switch for controlling the volume of music provided by an electronic device (e.g., a portable music player). As another example, a headset can include several buttons for controlling playback of music (e.g., play, next, last, fast forward, and rewind buttons).

A drawback of such switches that have been implemented in headset wires is that they tend to be bulky and have limited control functions.

BRIEF DESCRIPTION OF THE DRAWINGS

The disclosure will be readily understood by the following detailed description in conjunction with the accompanying drawings, wherein like reference numerals designate like structural elements, and in which.

Figure 1:
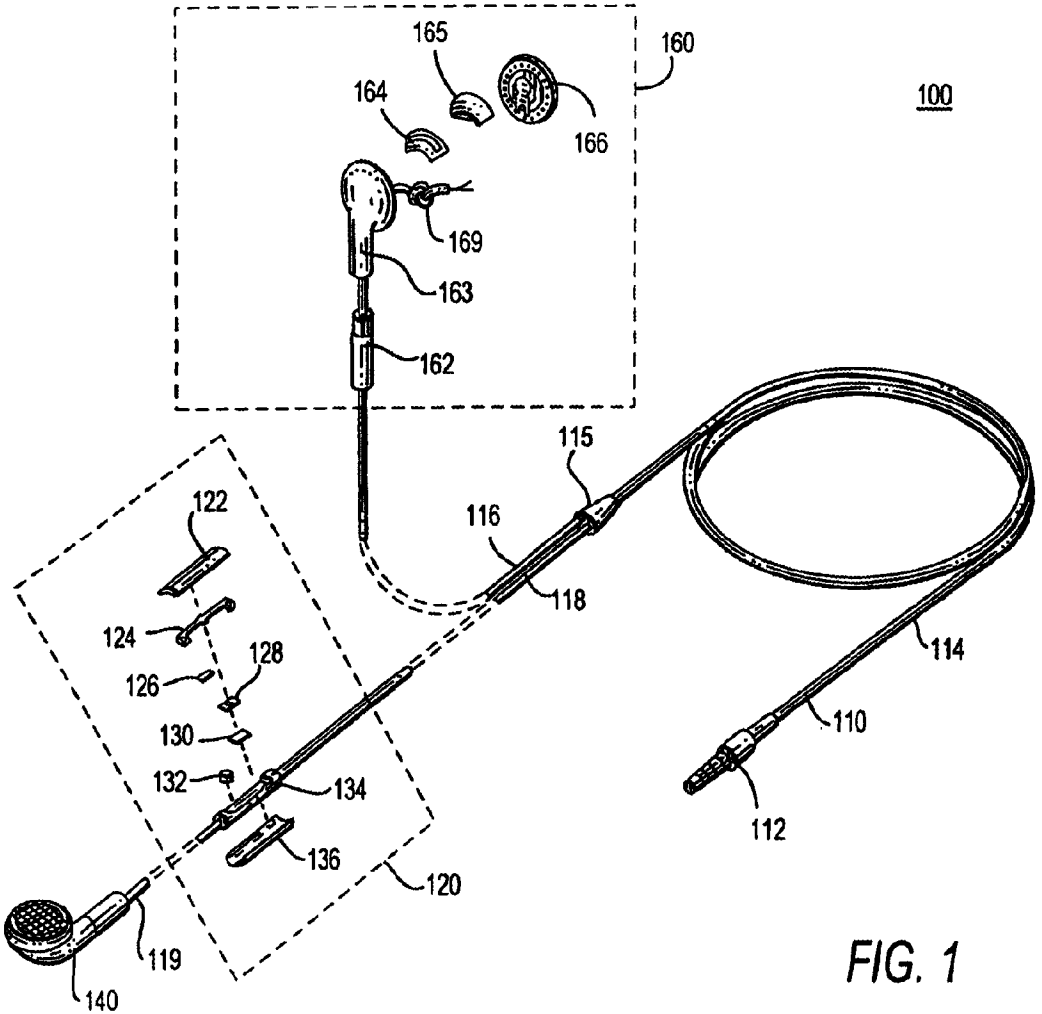
FIG. 1 illustrates an embodiment of a partial exploded view of a wired peripheral assembly system.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

SUMMARY OF THE INVENTION

Switches that can be incorporated in wires, that can feature small and unobtrusive profiles, and that can control one or more functions of devices coupled to the wires, are provided. Switches that can be easy to use without requiring users to look at the switches are also provided.

A wired peripheral assembly with an integrated switch assembly is provided. The integrated switch assembly can include a switch hidden from view by a housing. The switch can be activated when the user applies pressure to the housing. The housing may include a flexible housing cover that, when depressed, engages a switch contained within the housing. When engaged, the switch may move or "snap" to a switch activation position within the housing. When housing is no longer squeezed, the switch may return to a standby position within the housing, as the housing cover may no longer be depressed, and no longer engages the switch.

Incorporating the switch within the switch housing advantageously can eliminate the need to provide a discrete switch member that is visible (e.g., that protrudes from the housing), thus providing a more aesthetically pleasing housing with switch functionality. In addition, the relative ease in activating the switch in accordance with embodiments of the invention may be greater than that of peripheral assemblies (e.g., headsets) having discrete switch members because there may be no need to discern where the switch is located in order to activate the switch. The user can merely squeeze the housing of the integrated switch assembly to activate the switch.

The integrated switch assembly can be placed anywhere along a cord assembly that may physically and electrically interconnect one or more peripheral assemblies via wires to a plug or port that may communicate with an electronic device. The switch assembly can be used to control any suitable function of any suitable electronic device and/or any suitable peripheral assembly thereof. The electronic device may be of a variety of suitable electronic device forms, including, but not limited to, computers, media systems, portable media devices (e.g., portable music players, such as iPods™ available by Apple Computer, Inc. of Cupertino, Calif.), cellular telephones, personal media devices that may include telephone communication and digital music player capabilities, or combinations thereof. The one or more peripheral assemblies may each be of a variety of suitable peripheral assembly forms, including, but not limited to, acoustic assemblies or transducers (e.g., speakers, earbuds, or microphones), visual assemblies (e.g., cameras, video recorders, etc.), or combinations thereof. The functions that the switch assembly can be used to control may be any of a variety of suitable functions, including, but not limited to, microphone or speaker mute, volume control, media playback functions (e.g., next, previous, pause, play), dial, hang-up, or combinations thereof.

In certain headset embodiments, for example, having a single peripheral assembly (e.g., a monaural headphone having a single speaker or earbud), the integrated switch assembly may be placed along the cord assembly relatively near that single peripheral assembly. In certain other headset embodiments having two or more peripheral assemblies (e.g., stereo headphones having left and right speakers or earbuds), the integrated switch assembly may be generally associated with and placed along the cord assembly in relative proximity to one or the other peripheral assembly. For example, when the peripheral assembly is placed in a position of its intended use (e.g., placed in or near the ear or ears of the user), the integrated switch assembly can be positioned along the cord assembly such that the user can relatively easily locate the switch housing (as opposed to having the user fumble around for a switch located far away from the peripheral assembly).

Additionally, in some headset embodiments, for example, a switch assembly can include a microphone incorporated therein. When a peripheral assembly of such a headset is placed in a position of its intended use (e.g., placed in or near the ear or ears of the user), the integrated switch assembly and its microphone may be positioned along the cord assembly in relative proximity to an appropriate source of acoustic signals (e.g., the vocal chords of a user).

In certain embodiments, a microphone can be contained within the switch housing of a switch assembly and hidden from view. A housing cover can include a through-hole for enabling acoustic signals to be received by the microphone. The microphone can include two leads that are electrically and physically coupled to a circuit board (e.g., a printed wiring board). The circuit board can be electrically and physically coupled to wires (e.g., a MIC wire and a ground wire) that may extend along the cord assembly to a plug connected thereto. The circuit board can serve as a bridge for electrically coupling the leads from the microphone to the wires extending along the cord assembly to the plug. The circuit board can electrically interact with the switch when the switch is depressed and placed in a switch activation position. For example, when the switch is activated, the switch can short the two microphone leads by applying a conductive member to the circuit board, thereby activating or de-activating the microphone).

The integrated switch assembly can include cord assembly fasteners or crimps that securely fix the switch assembly to the cord assembly. For example, a first fastener can secure a plug portion of the cord assembly and a second fastener can secure a peripheral portion of the cord assembly. Wires of the cord assembly (e.g., positive and ground wires) can be routed through the switch assembly without interfering with the switch, and in some embodiments the microphone. In addition, the fasteners can be located within the switch housing, thereby making the cord assembly appear integrated with the switch housing, thereby making the cord assembly appear integrated with the switch housing. This can provide an aesthetically pleasing appearance and also can make the switch assembly appear as a relatively non-descript and seamless extension of the cord assembly.

DETAILED DESCRIPTION OF THE INVENTION

Switches are provided that can be incorporated in wires to have small and unobtrusive profiles, and that can control one or more functions of devices coupled to the wires, and are described below with reference to FIGS. 1-10.

Figure 10:
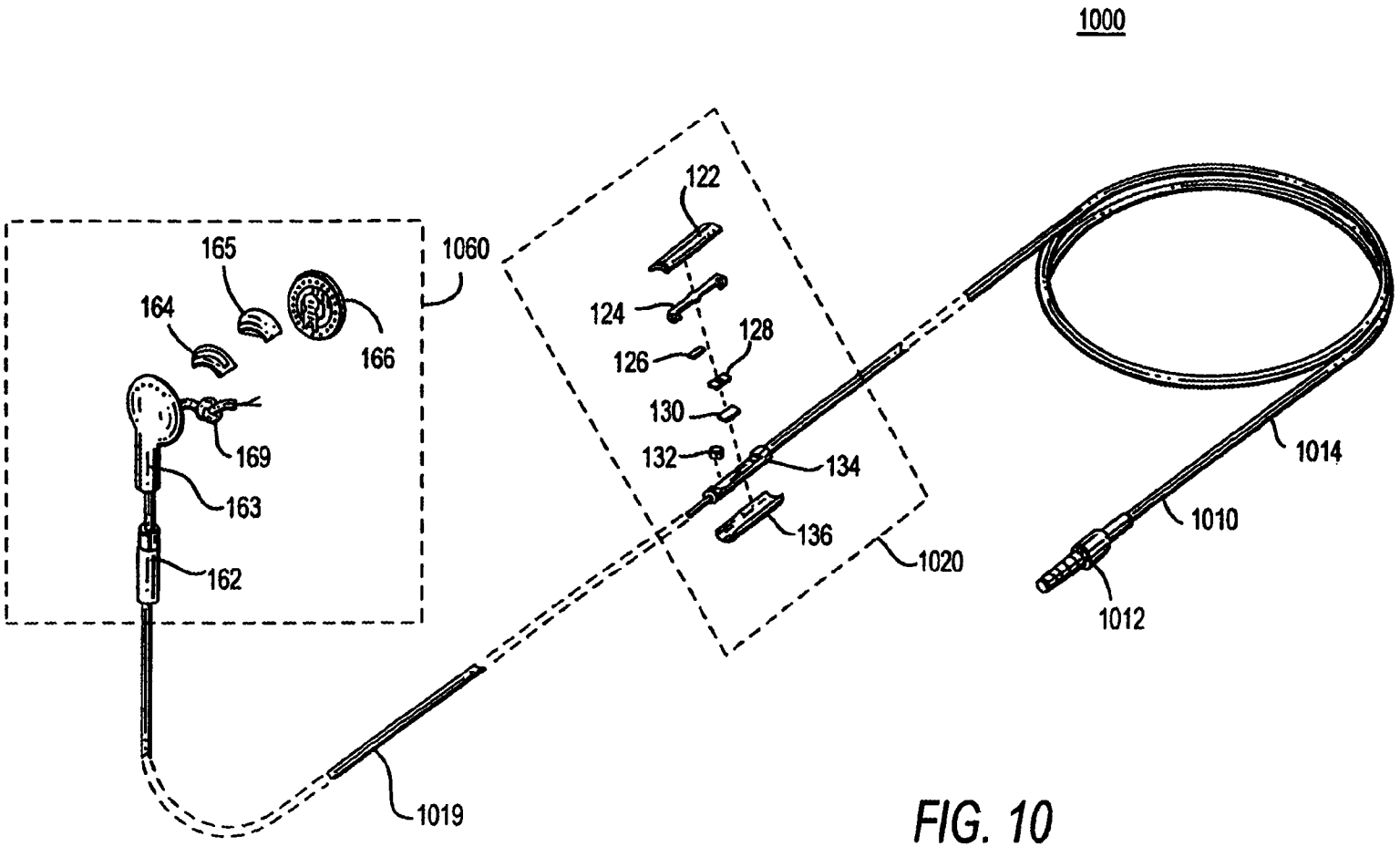
FIG. 10 illustrates a partial exploded view of a wired monaural headset with an integrated switch assembly in accordance with a described embodiment.

FIG. 1 shows a partial exploded view of a wired peripheral assembly system 100. System 100 can be a wired stereo headset with an integrated switch assembly and two peripheral acoustic assemblies in accordance with an embodiment of the invention. Headset system 100 can include cord assembly 110, integrated switch assembly 120, and left and right acoustic assemblies 140 and 160. FIG. 10 shows a partial exploded view of a wired monaural headset 1000 with an integrated switch assembly in accordance with an embodiment of the invention. Headset 1000 can include substantially all of the same components as stereo headset 100, with the exception that there is only one acoustic assembly instead of two. Thus, because there is a duplication of like components between headsets 100 and 1000, the following detailed discussion of components of headset 100, such as the cord assembly, switch assembly, and one of the acoustic assemblies, can be equally applicable to such similar components of headset 1000.

Cord assembly 110 can include plug 112 and the one or more wires (not shown) that can electrically couple plug 112 to integrated switch assembly 120, and right and left acoustic assemblies 140 and 160. The wires can be enclosed within a shroud (shown as elements 114, 116, 118, and 119) that may protect the wires from external elements, such as water and dirt. For example, shroud 114 may contain all wires electrically coupled to plug 112, whereas shroud 116 may contain only the wires for right acoustic assembly 160 and shrouds 118 and 119 may contain only the wires for switch assembly 120 and left acoustic assembly 140. Shroud interconnector 115 can interconnect shrouds 114, 116, and 118, while switch assembly 120 can interconnect shrouds 118 and 119.

Acoustic assemblies 140 and 160 may be speakers that produce acoustic signals in response to signals transmitted through cord assembly 110. Acoustic assemblies 140 and 160 may be earbuds as shown, or may be some other in-the-ear, cover-the-ear, or over-the-ear type of speaker assemblies. Acoustic assembly 160, shown as an exploded view, can include jacket 162, housing 163, pressure sensitive adhesive 164, damper 165, and driver unit 166. Pressure sensitive adhesive 164, damper 165, and driver unit 166 can be fixed to housing 163, and wires 169 from shroud 116 can be coupled to driver unit 166. Jacket 162 can also be connected to housing 163.

Switch assembly 120 can be integrated anywhere along cord assembly 110. In some embodiments, such as that shown in FIG. 1, switch assembly 120 may be integrated with the wires and shroud associated with one of the acoustic assemblies. That is, as shown in FIG. 1, switch assembly 120 can appear to be incorporated into shroud 118 existing between left acoustic assembly 140 and interconnector 115. In other embodiments (not shown), switch assembly 120 can be generally associated with right acoustic assembly 160 and incorporated into shroud 116, or switch assembly 120 can be generally associated with plug 112 and incorporated into shroud 114.

The actual position of switch assembly 120 can be such that it is placed a predetermined distance away from acoustic assembly 140 to provide a user with relatively easy access to switch assembly 120 when assembly 140 is located in the user's ear. For example, a switch located near an acoustic assembly may be more readily accessible than a switch located near plug 112 when headset 100 is in use. Moreover, in embodiments where switch assembly 120 includes a microphone, such as microphone 132, switch assembly 120 may be positioned a predetermined distance away from the acoustic assembly (e.g., assembly 140) to maximize reception of a user's voice.

Figure 2:
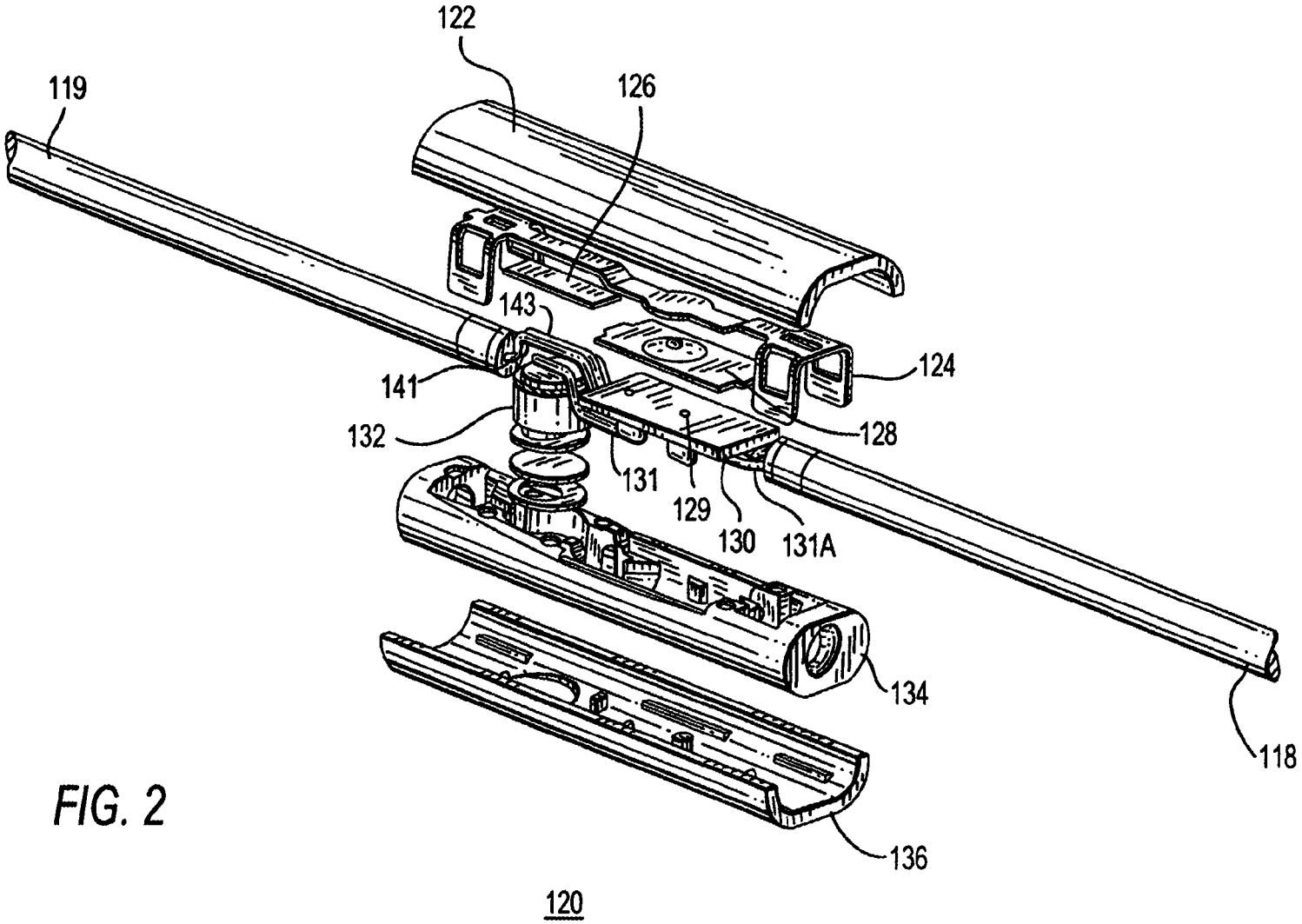
FIG. 2 illustrates an exploded view showing top and bottom housing covers positioned around a core, a pair of leads, and a shroud, in accordance with the described embodiments.
Figure 3:
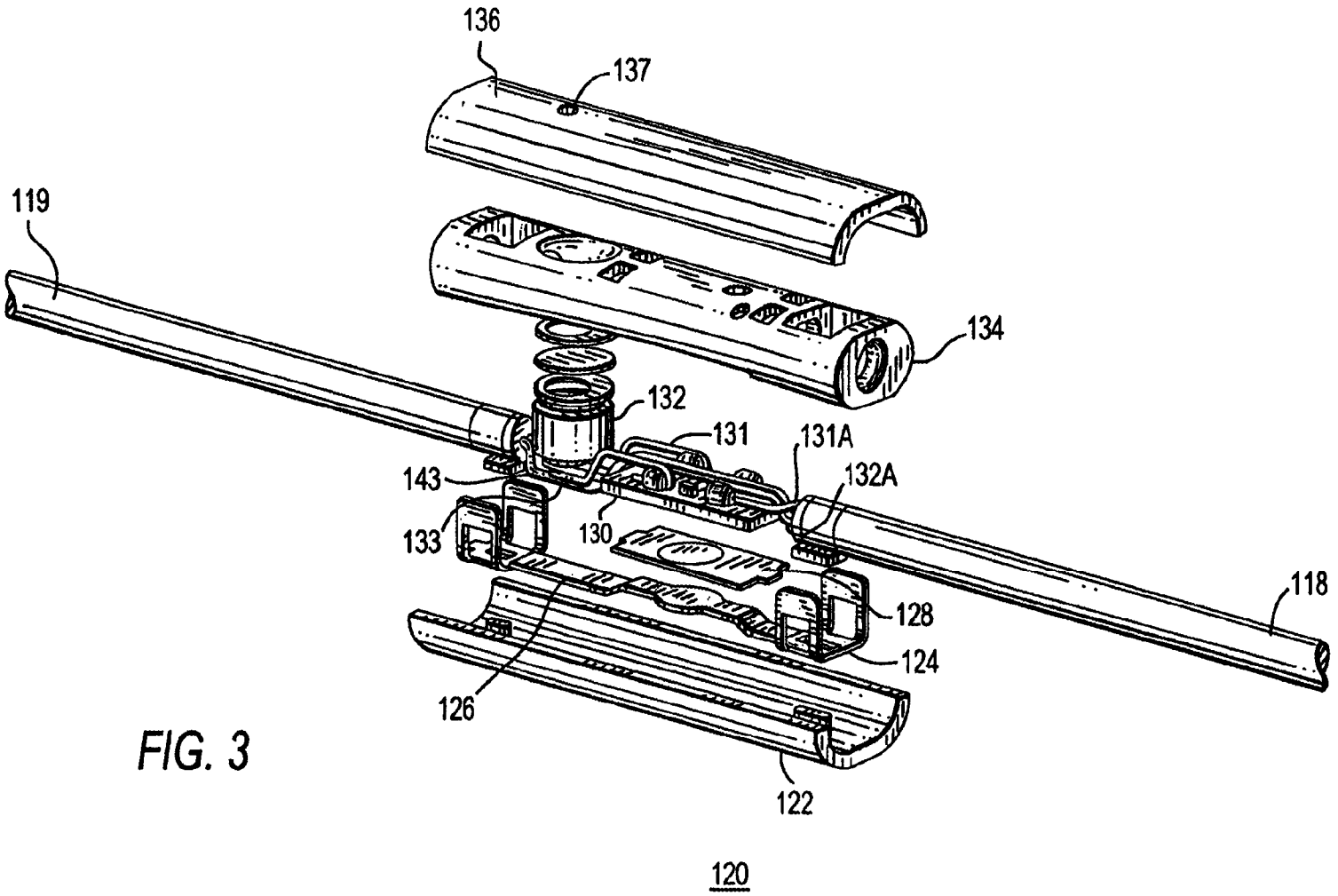
FIG. 3 illustrates the embodiment of the headset shown in FIG. 2, rotated 180 degrees.
Figure 4:
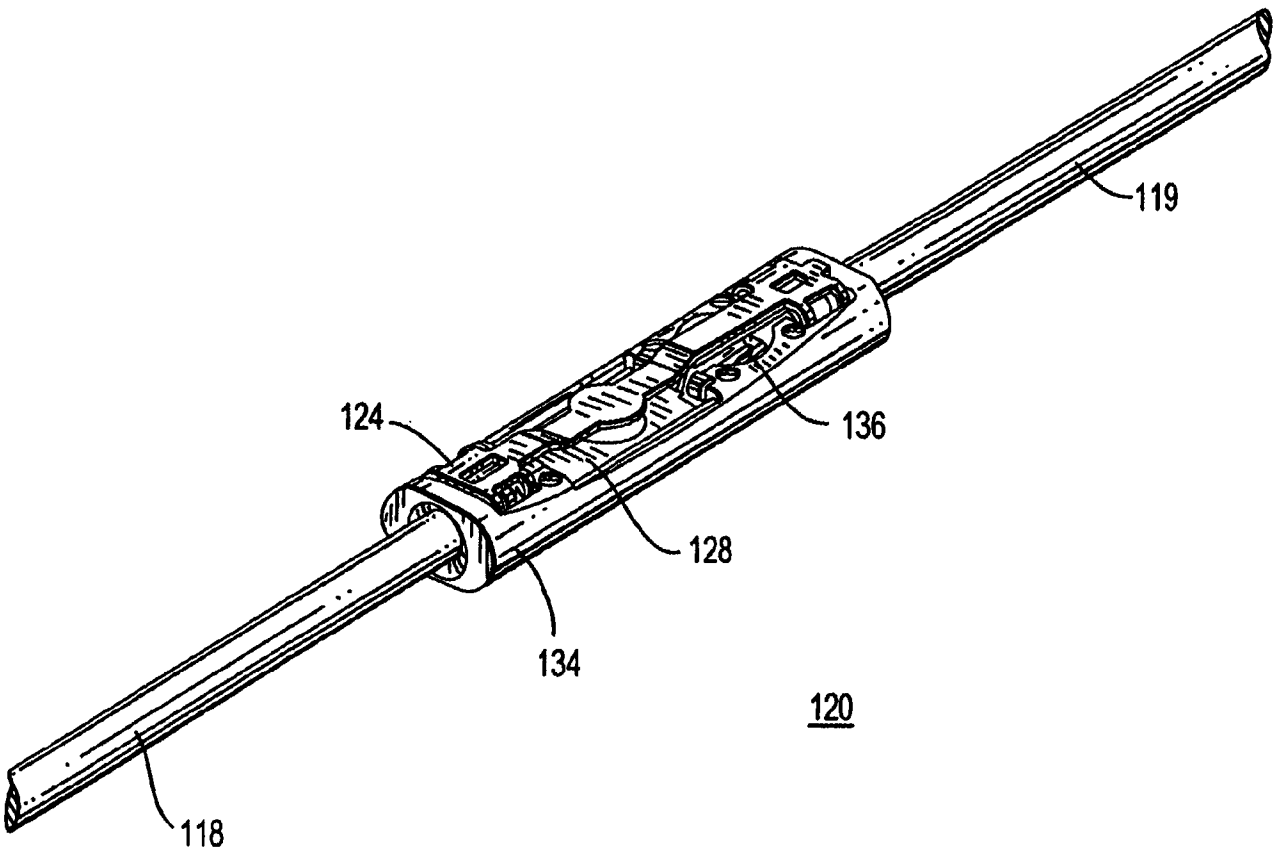
FIG. 4 illustrates the embodiment of the headset shown in FIG. 2 with the top and bottom housing covers removed to illustrate the core assembled with the shroud.
Figure 5:
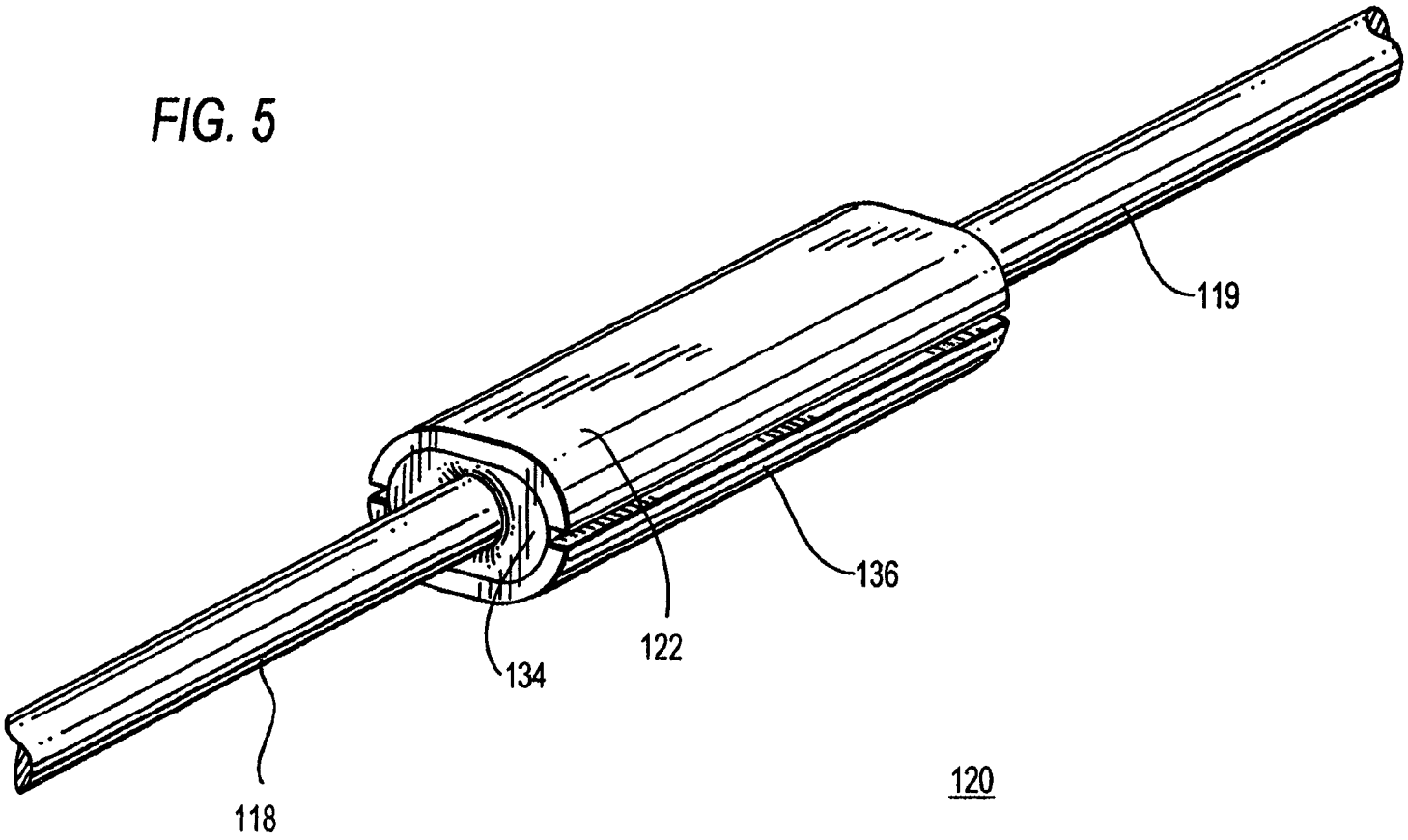
FIG. 5 illustrates the embodiment of the headset shown in FIG. 2, with the components fully assembled.
Figure 6:
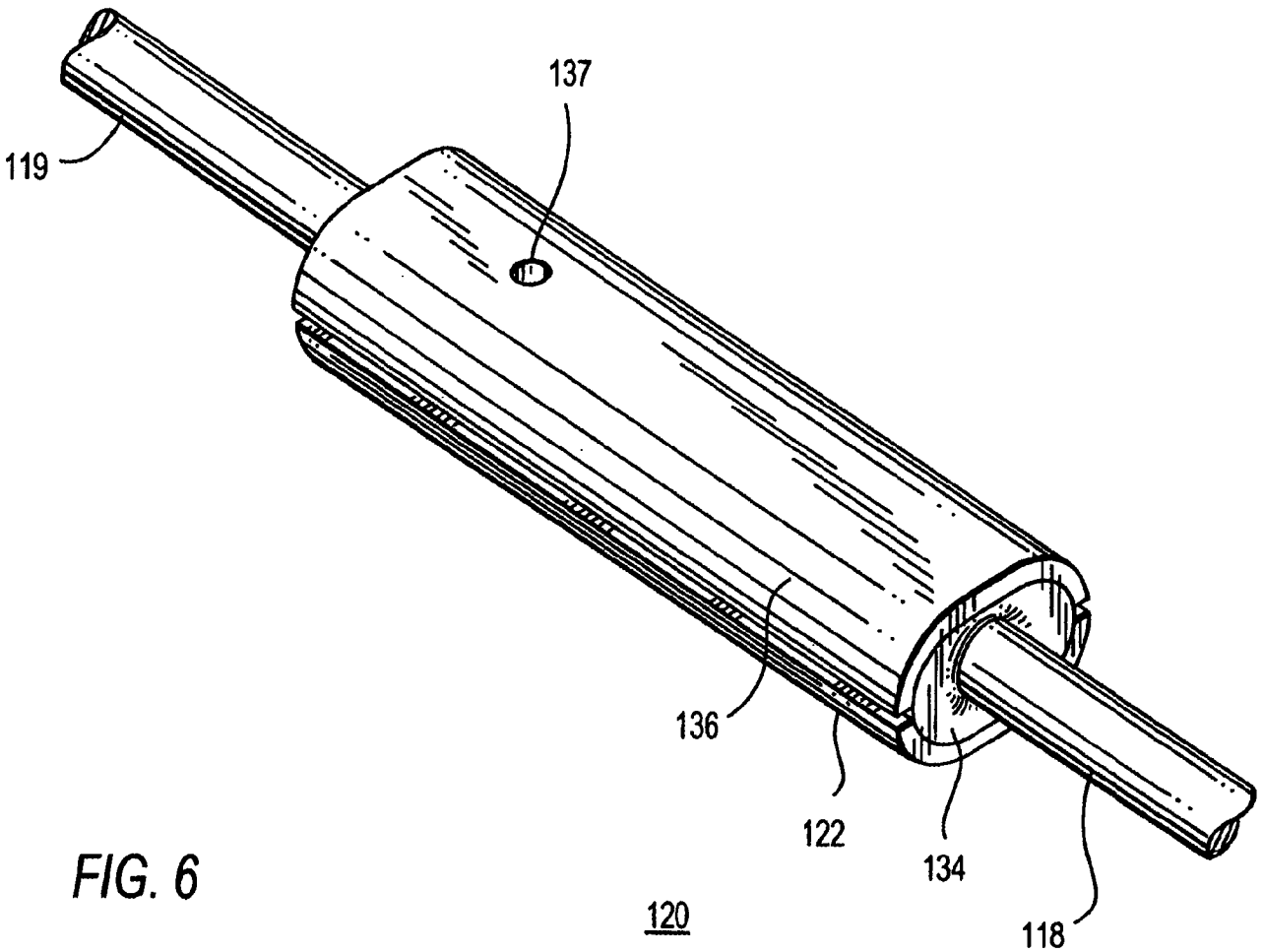
FIG. 6 illustrates the embodiment of the headset shown in FIG. 5, rotated 180 degrees to show a through-hole for the microphone.
Figure 7:
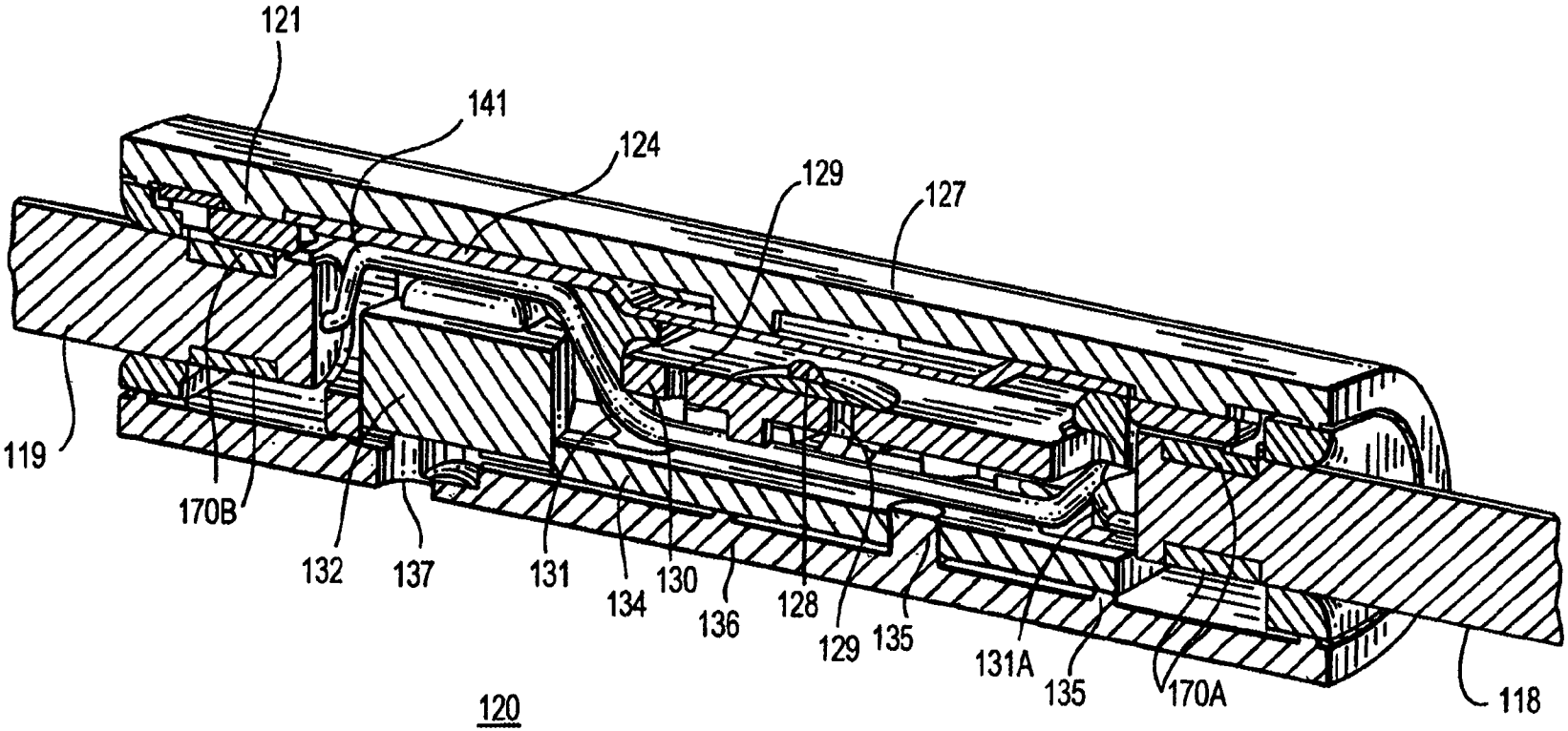
FIGS. 7 and 8 illustrate cross sectional views of an embodiment of a headset showing internal components.
Figure 8:
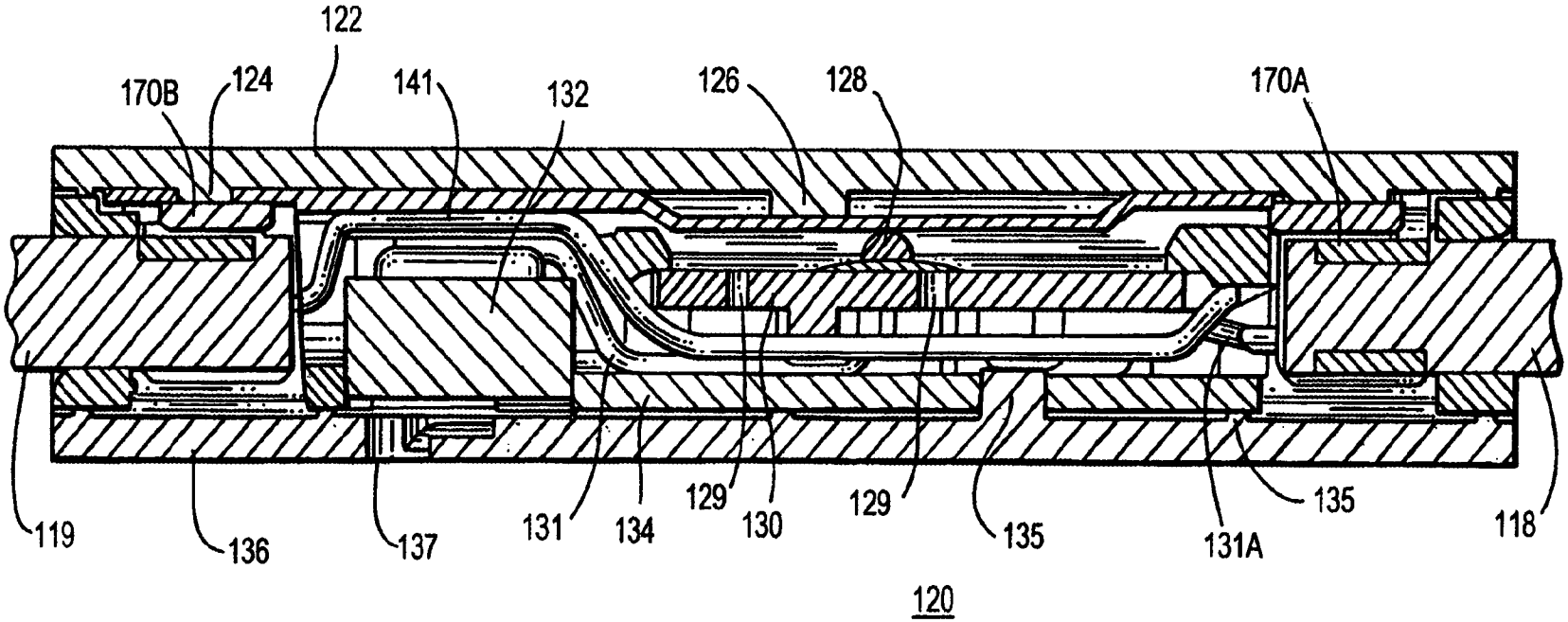
Figure 9:
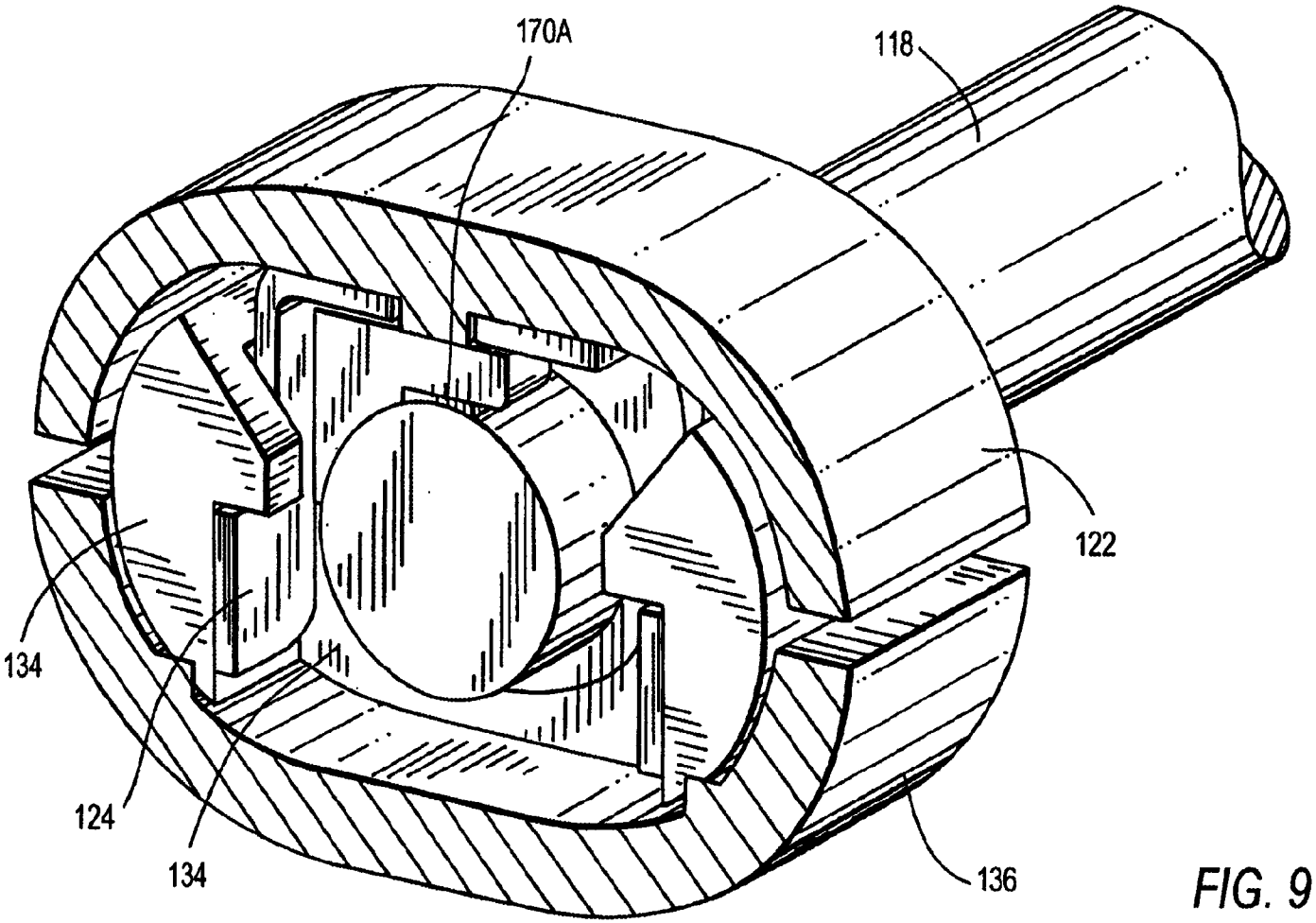
FIG. 9 illustrates a cross sectional view of a headset showing an integrated switch assembly crimped inside top and bottom cover housings.

As shown in FIGS. 1, 2, and 3 in exploded view, for example, switch assembly 120 can be integrated into shroud 118 existing between left acoustic assembly 140 and interconnector 115. Switch assembly 120 can be constructed such that various assembly components (e.g., snap 124, insulator 126, switch 128, circuit board assembly 130, and microphone 132) can be packaged substantially within housing core 134. Housing core 134 can protect the components from damage and may securely retain them therein.

As shown, integrated switch assembly 120 can also include top housing cover 122 and bottom housing cover 136 that may substantially enclose housing core 134 and components 124, 126, 128, 130, and 132. Illustrations of an assembled switch assembly 120 may be seen, for example, in FIGS. 5-8, which show perspective top, perspective bottom, perspective cross-sectional, and horizontal cross-sectional views of an assembled switch assembly in accordance with an embodiment of the invention. As shown, for example, top cover 122 can have one or more protrusions 121 that may snap tightly into passes in snap 124 and core 134, while bottom cover 136 can have one or more protrusions 135 that may snap tightly into passes in core 134 for encapsulating the other components of assembly 120 between covers 122 and 136. Top and bottom housing covers 122 and 136 can hide the components contained within switch assembly 120, thereby providing an integrated switch assembly with a switch (e.g., switch 128 of FIGS. 1-3) hidden from view.

In certain embodiments, microphone 132 can be contained within the housing of switch assembly 120 and can be hidden from view like switch 128. As shown in FIGS. 3 and 6-8, for example, housing cover 136 can include a through-hole 137 for enabling acoustic signals to be received by microphone 132. The microphone can include two leads (see, e.g., leads 131 and 133) that can be electrically and physically coupled to circuit board 130 (e.g., a printed wiring board). Circuit board 130 can be electrically and physically coupled to wires (e.g., a MIC wire 131A and a ground wire 133A) that may extend along cord assembly 110 towards plug 112 connected thereto. Circuit board 130, therefore, can serve as a bridge for electrically coupling leads 131 and 133 from microphone 132 to wires 131A and 133A that can extend within shroud 118 along cord assembly 110 from assembly 120 towards shroud interconnector 115 (and, eventually, plug 112).

Furthermore, in certain embodiments, circuit board 130 can be configured to electrically interact with switch 128 when the switch is depressed and placed in a switch activation position. For example, when switch 128 is activated, the switch can short the two microphone leads (e.g. leads 131 and 133) by applying one or more conductive members to circuit board 130 via one or more contacts 129 in the board. Therefore, in certain embodiments, switch 128 of assembly 120 can activate or de-activate microphone 132. Alternatively, switch 128 can change another function of microphone 132 (e.g., changing the sensitivity of the microphone). It is to be understood that two or more switches 128 can be provided to interact with circuit board 130, such that multiple switches may be used by a user to switch various functions of microphone 132 jointly.

An advantage of switch assembly 120 is that the assembly itself can be squeezed by a user to execute a switch activation event (which may be performed when switch 128 is depressed). That is, there may be no need to provide a discrete switch that protrudes, for example, from a housing to enable a user to execute a switch activation event. Thus, incorporating switch 128 within housing covers 122 and 136 can provide a switch assembly that is easy to use and that is aesthetically pleasing.

For example, in certain embodiments, switch 128 of integrated switch assembly 120 can be activated when the housing is squeezed. For example, top cover housing 122 can be a flexible housing cover that, when depressed, can engage switch 128 (in certain embodiments, via snap 124) contained within housing core 134. When engaged, switch 128 can move or "snap" to a switch activation position within assembly 120. When the housing of assembly 120 is no longer squeezed, switch 128 (and in certain embodiments, snap 124) can return to a standby position within assembly 120, as flexible top housing cover 122 may no longer be depressed, and therefore may no longer engage switch 128. Thus, the housing of assembly 120 can hide switch 128 from view of the user, thereby providing a small and aesthetically pleasing switch assembly with an unobtrusive profile for an electronic device.

In certain embodiments, integrated switch assembly 120 can include cord assembly fasteners or crimps 170 that securely fix the switch assembly to the cord assembly. For example, as shown in FIGS. 2, 3, and 7-9, a first fastener 170A can secure shroud 18 to assembly 120 and a second fastener 170B can secure shroud 119 to assembly 120. In addition, fasteners 170 can be located within the housing of switch assembly 120, thereby making cord assembly 110 appear integrated with the switch housing. This can provide an aesthetically pleasing appearance and also can make switch assembly 120 appear as a relatively non-descript and seamless extension of cord assembly 110.

For example, as shown in FIGS. 2, 3, and 7-9, certain wires of cord assembly 110 (e.g., positive wire 141 and ground wire 143) can be routed from left acoustic assembly 140 and shroud 119, through switch assembly 120 via fasteners 170A and 170B, and into shroud 118 towards shroud interconnector 115 and plug 112 without interfering with switch 128 or any other component of assembly 120. In other embodiments, however, one or more wires routed from plug 112 towards left acoustic assembly 140 (e.g., wires 141 and 143) can be electrically and physically coupled to board 130, such that, when switch 128 is activated, the switch can change a function of left acoustic assembly 140. In yet another embodiment, switch 128 of assembly 120 can change another function of the device coupled to plug 112 by shorting other leads running from board 130 towards plug 112 that are independent of microphone 132 and left acoustic assembly 140.

Figure 1A:
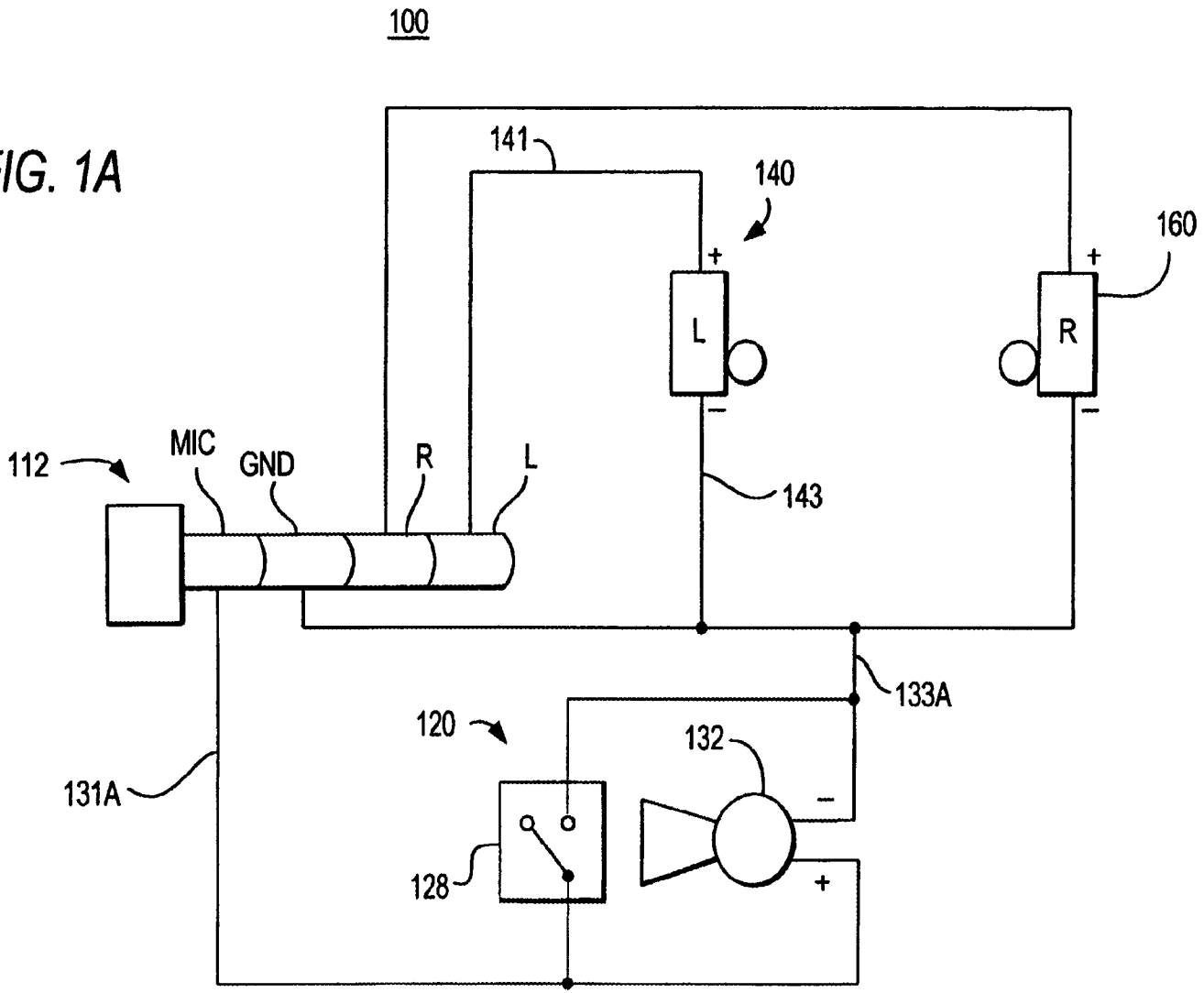
FIG. 1A illustrates an electrical diagram of an embodiment of a simplified schematic diagram of a headset system having a switch assembly configured such that a switch can change a function of a microphone.

FIG. 1A is an illustrative simplified schematic diagram of headset system 100 having switch assembly 120 configured such that switch 128 can change a function of microphone 132. System 100 can be implemented with any suitable electronic device, such as, for example, an audio and/or video device (e.g., a portable music player, such as an iPod™ available by Apple Computer, Inc. of Cupertino, Calif.), a communication device (e.g., a cellular telephone), a personal media device that may include telephone communication and digital music player capabilities, or any other electronic device that can operate in connection with a switch. System 100 will now be described in the context of a circuit coupled to a cellular telephone, but it will be understood that this is merely illustrative and that system 100 can be coupled to any other suitable device.

As shown in FIG. 1A, for example, and as described above, system 100 can include plug 112, left acoustic assembly 140, right acoustic assembly 160, and microphone 132 that can be activated by switch 128 of switch assembly 120. Plug 112, which can be plugged into a cellular telephone (not shown), includes four sections: left channel section L, right channel section R, microphone section MIC, and ground section GND. Wires can connect right acoustic assembly 160 to right channel section R and ground section GND. Wires (e.g., wires 141 and 143) can connect left acoustic assembly 140 to left channel section L and ground GND. Wires (e.g., wires 131A and 133A) can connect microphone 132 to microphone section MIC and ground GND via switch 128. In some embodiments, switch 128 can be coupled to each of the wires connecting microphone 132 to plug 112 (not shown).

The cellular telephone coupled to circuit 100 can respond to signals that are provided by switch 128 in any suitable manner. For example, when switch 128 is in a closed switch position, software implemented on the cellular telephone may detect the presence of a signal provided through microphone section MIC of plug 112. The software may process the signal and determine that microphone 132 has been activated. The cellular telephone can then transmit the sounds (e.g. the voices) picked up by microphone 132 over the cellular connection to another cellular telephone. As another example, when switch 128 is in the open switch position, the software implemented on the cellular telephone may determine that no signals are received in microphone section MIC and turn off the microphone function of the cellular telephone. A more detailed description of how the cellular telephone responds to actuation of a switch can be found in commonly assigned U.S. Patent Application Publication No. 2008/0149417 published Jun. 26, 2008, which is incorporated by reference herein in its entirety.

Figure 11:
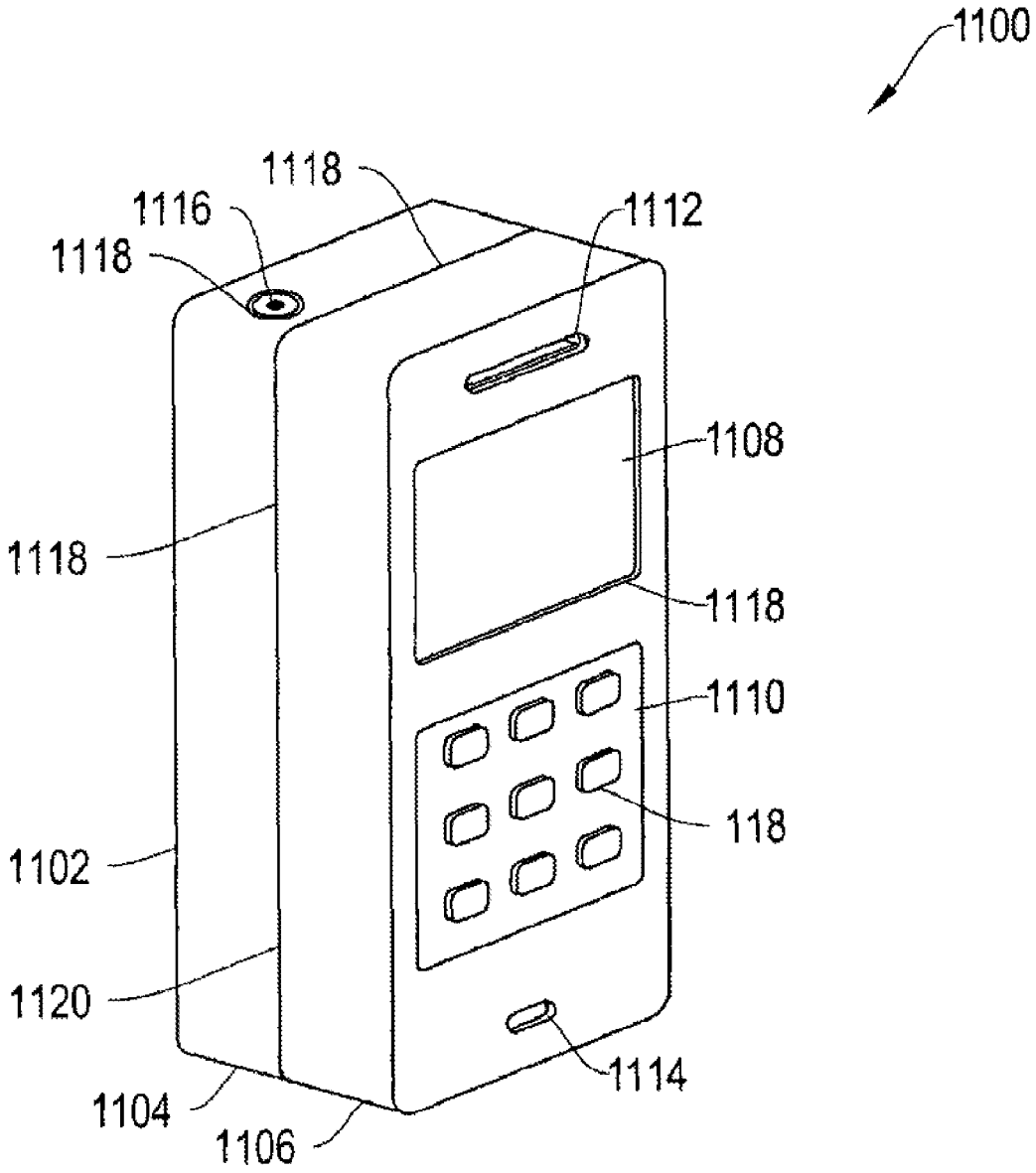
FIG. 11 illustrates a perspective view of a media device according to an illustrative embodiment of the invention.

FIG. 11 is a perspective view of a media device 1100 according to an illustrative embodiment of the invention. The media device 1100 includes a housing 1102, a first housing portion 1104, a second housing portion 1106, a display 1108, a keypad 1110, a speaker housing aperture 1112, a microphone housing aperture 1114, and a headphone jack 1116. The housing 1102 also includes various gaps 1118 that may include openings, separations, vents, or other pathways between elements of the housing 1102 that enable the passage of air or sound through the housing 1102.

In one embodiment, the housing 1102 includes a first housing portion 1104 and a second housing portion 1106 that are fastened together to encase various components of the media device 1100. The housing 1102 and its housing portions 1104 and 1106 may include polymer-based materials that are formed by, for example, injection molding to define the form factor of the media device 1100. In one embodiment, the housing 1102 surrounds and/or supports internal components such as, for example, one or more circuit boards having integrated circuit components, internal radio frequency (RF) circuitry, an internal antenna, a speaker, a microphone, a hard drive, a processor, and other components. The housing 1102 provides for mounting of a display 1108, keypad 1110, external jack 1116, data connectors, or other external interface elements. The housing 1102 may include one or more housing apertures 1112 to facilitate delivery of sound, including voice and music, to a user from a speaker within the housing 1102. The housing 1102 may include one or more housing apertures 1114 to facilitate the reception of sounds, such as voice, for an internal microphone from a media device user.

In certain embodiments, the housing 1102 includes one or more gaps 1118 associated with the housing 1102. These gaps 1118 may result from the manufacturing and/or assembly process for the media device 1100. For example, in certain circumstances, the mechanical attachment of the first housing portion 1104 with the second housing portion 1106 results in a crease 1120 or joint between the portions 1104 and 1106. In certain media devices 1100, the crease 1120 is not air tight, resulting in gaps 1118 along the crease. Other gaps may be formed during assembly between, for example, one or more keys of the keypad 1110 and the housing 1102 or the display 1108 and the housing 1102, resulting in additional gaps 1118. In other embodiments, the housing 1102 may include addition portions that are integrated to form the housing 1102 for the media device 1100.

The media device 1100 may include a wireless communications device such as a cellular telephone, satellite telephone, cordless telephone, personal digital assistant (PDA), pager, portable computer, or any other device capable of wireless communications. In fact, FIG. 1 shows an exemplary cellular telephone version of a broad category of media device 1100.

The media device 1100 may also be integrated within the packaging of other devices or structures such a vehicle, video game system, appliance, clothing, helmet, glasses, wearable apparel, stereo system, entertainment system, or other portable devices. In certain embodiments, device 1100 may be docked or connected to a wireless enabling accessory system (e.g., a wi-fi docking system) that provides the media device 1100 with short-range communicating functionality. Alternative types of media devices 1100 may include, for example, a media player such as an iPod available by Apple Computer Inc., of Cupertino, Calif., pocket-sized personal computers such as an iPAQ Pocket PC available by Hewlett Packard Inc., of Palo Alto, Calif. and any other device capable of communicating wirelessly (with or without the aid of a wireless enabling accessory system).

In certain embodiments, the media device 1100 may synchronize with, for example, a remote computing system or server to receive media (using either wireless or wireline communications paths). Wireless syncing enables the media device 1100 to transmit and receive media and data without requiring a wired connection. Media may include, without limitation, sound or audio files, music, video, multi-media, and digital data, in streaming and/or discrete (e.g., files and packets) formats.

While there have been described headsets with integrated switches, it is to be understood that many changes may be made therein without departing from the spirit and scope of the present invention. For example, it is to be understood that, although switch assembly 120 has been described as being integrated into a wired headset 100 including one or more acoustic assemblies, switch assembly 120 of the present invention may be integrated into any suitable wired peripheral assembly system having any number of various types of peripheral assemblies, such as a camera. It will also be understood that various directional and orientational terms such as "top" and "bottom," and the like are used herein only for convenience, and that no fixed or absolute directional or orientational limitations are intended by the use of these words. Those skilled in the art will appreciate that the invention can be practiced by other than the described embodiments, which are presented for purposes of illustration rather than of limitation, and the invention is limited only by the claims which follow.

What is claimed is:

1. An electronic device capable of being controlled by a switch assembly of a headset when coupled to the headset, the electronic device comprising:

an interface that connects to the headset, the headset comprising:

a switch;

a microphone;

a top housing cover free of an opening; and a bottom housing cover coupled with the top housing cover, wherein:

the top housing cover and the bottom housing cover fully cover the switch and the microphone, the top housing cover extends a length of the switch assembly, and the switch assembly is free of a discrete element protruding through the top housing cover; and a software program configured to detect a signal from a microphone section of the interface when a switch in the headset is in a closed position, wherein when the switch is in an open position the software program turns off a microphone function within the electronic device, and wherein a force applied to at least one of the top housing cover and the bottom housing cover actuates the switch.

2. The electronic device as recited in claim 1, wherein the electronic device is configured to transmit a sound received by the microphone to a second electronic device over a connection between the electronic device and the second electronic device, and wherein the bottom housing cover includes a single opening.

3. The electronic device as recited in claim 1, wherein the electronic device is selected from a portable media device, cellular telephone, and digital music player.

4. The electronic device as recited in claim 1, further comprising an audio signal stored on a memory circuit, wherein the electronic device is configured to transmit the audio signal to the headset.

5. The electronic device as recited in claim 1, wherein the software program is configured to process the signal and determine the microphone of the headset is activated.

6. The electronic device as recited in claim 1, further comprising:

a processor configured to run the software program; and a memory circuit configured to store the software program.

7. The electronic device as recited in claim 6, further comprising communications circuitry configured to couple the electronic device to the switch assembly.

8. A system, the system comprising:

an electronic device;

a headset coupled to the electronic device, the headset having an integrated switch assembly comprising:

a top cover and a bottom cover combining to define a flexible housing cover having a first end, a second end, and a central portion between the first end and the second end;

a switch located at the central portion configured to change a function of the electronic device;

a microphone at the first end;

a housing core extending from the first end to the second end, the housing core receiving the switch and the microphone; and a circuit board assembly coupled to the switch and the microphone, wherein the electronic device is configured to receive sound from the microphone, and wherein the switch is in a closed switch position when the flexible housing cover is depressed.

9. The system as recited in claim 8, wherein the electronic device is a cellular telephone and where the function is selected from a group consisting of a volume increase, a volume decrease, a speaker mute, media playback function, a dial, and a hang-up.

10. The system as recited in claim 8, wherein the switch is configured to activate or deactivate the microphone.

11. The system as recited in claim 8, wherein the microphone is capable of receiving a sound and sending the sound to the electronic device.

12. The system as recited in claim 8, wherein the headset is coupled to the electronic device via a wireless channel.

13. The system as recited in claim 12, wherein the headset receives an audio signal from the electronic device via the wireless channel.

14. The system as recited in claim 8, wherein the integrated switch assembly is positioned between a first cover and a second cover.

15. The system as recited in claim 14, wherein when the first cover is depressed, the switch is in an activation position.

16. The system as recited in claim 15, wherein when the first cover is free of depression, the switch returns to a standby position different from the activation position.

17. A method for controlling an electronic device using a headset having a switch, the method comprising:

receiving a top cover and a bottom cover to define a housing cover of the headset to enclose all contents associated with the switch, wherein the housing cover receives a first wire at a first end and a second wire at a second end opposite the first end;

depressing only the housing cover to cause the switch to be in a closed switch configuration; and changing a function of the electronic device based upon the closed switch configuration, wherein the top cover is a unitary body free of a through-hole and the bottom cover includes a single through-hole that is free of a discrete element protruding through the bottom cover.

18. The method as recited in claim 17, wherein the function is selected from a group consisting of a volume increase, a volume decrease, and media playback function.

19. The method as recited in claim 18, further comprising upon depressing the housing cover, actuating the switch, wherein actuating the switch changes the function of the electronic device.

20. The method as recited in claim 17, further comprising:

forming a through-hole in the housing cover; and positioning a microphone within the housing cover, wherein the electronic device is capable of receiving a sound from the microphone and transmitting the sound to a second electronic device.

* * * * *